US007461830B2

(12) United States Patent
Newman

(10) Patent No.: US 7,461,830 B2
(45) Date of Patent: Dec. 9, 2008

(54) MULTIPLE SENSOR FOR PREVENTING A CROWN-BLOCK INCURSION ON AN OIL WELL RIG

(75) Inventor: Frederic M. Newman, Midland, TX (US)

(73) Assignee: Key Energy Services, Inc, Houston, TX (US)

( * ) Notice: Subject to any disclaimer, the term of this patent is extended or adjusted under 35 U.S.C. 154(b) by 770 days.

(21) Appl. No.: 10/942,730

(22) Filed: Sep. 16, 2004

(65) Prior Publication Data

US 2005/0114001 A1 May 26, 2005

Related U.S. Application Data

(63) Continuation-in-part of application No. 10/720,594, filed on Nov. 24, 2003.

(60) Provisional application No. 60/428,506, filed on Nov. 25, 2002.

(51) Int. Cl.
*B66D 1/48* (2006.01)

(52) U.S. Cl. ..... 254/267; 254/269; 254/275

(58) Field of Classification Search ..... 254/267, 254/269, 274, 275, 268

See application file for complete search history.

(56) References Cited

U.S. PATENT DOCUMENTS

| | | | | |
|---|---|---|---|---|
| 4,334,217 | A | 6/1982 | Nield et al. | 340/685 |
| 5,342,020 | A * | 8/1994 | Stone | 254/269 |
| 5,405,027 | A | 4/1995 | Plass | 212/152 |
| 6,135,421 | A | 10/2000 | Bartelme et al. | 254/268 |
| 6,343,703 | B1 | 2/2002 | Fleagle et al. | 212/281 |
| 7,138,925 | B2 * | 11/2006 | Nield | 340/685 |
| 7,226,037 | B2 * | 6/2007 | Newman | 254/274 |
| 7,293,761 | B2 * | 11/2007 | Malek et al. | 254/275 |

* cited by examiner

*Primary Examiner*—Emmanuel M Marcelo
(74) *Attorney, Agent, or Firm*—King & Spalding LLP

(57) ABSTRACT

The technology disclosed herein provides a multiple sensor system that prevents crown incursion by a traveling block in an oil rig. This system calculates traveling block position, traveling block velocity and weight supported by the traveling block, and uses this information to calculate emergency stopping positions to prevent crown out by the traveling block. The system takes all these parameters into consideration when slowing and/or stopping the traveling block when it reaches a crown out position. The result is much safer operation of the traveling block on a workover rig, as well as on an oil drilling rig.

31 Claims, 14 Drawing Sheets

BLOCK DIAGRAM OF CROWN AND FLOOR SAVER DEVICE

MULTIPLE SENSOR FOR PREVENTING A CROWN-BLOCK INCURSION ON AN OIL WELL RIG

This application is a continuation in part of co-pending non-provisional application Ser. No. 10/720,594, filed Nov. 24, 2003, which in turn was based on provisional application No. 60/428,506, filed Nov. 25, 2002.

BACKGROUND OF THE INVENTION

After an oil drilling rig drills a well and installs the well casing, the rig is dismantled and removed from the site. From that point on, a mobile repair unit, or workover rig, is typically used to service the well. Servicing includes, for example, installing and removing inner tubing strings, sucker rods, and pumps. This is generally done with a cable hoist system that includes a traveling block that raises and lowers the aforementioned tubing strings, sucker rods, and pumps.

U.S. Pat. No. 4,334,217 describes a system for monitoring the movement of a travelling block on a drilling rig. As described in the '217 patent, the traveling block can be raised or lowered beyond a safe limit. This is called "crown out" if the traveling block reaches its upper most safe position, and "floor out" if it reaches its lower most safe is position. Crown out/floor out can result in equipment damage and/or present a hazard to personnel working on the equipment. Because it is often not possible for the operator of the cable hoist system to see the position of the traveling block, or because the operator can be otherwise distracted from the position of the traveling block, the operator can inadvertently exceed safe positions of the traveling block.

The '217 patent identified the problem of unsafe hoist operation, and proposed a solution in which the total distance traveled by the traveling block is measured, and then compared with a reference point, such as the uppermost (crown) and lowermost (floor) position, of the traveling block. An electronic system was provided for displaying the position of the traveling block to the operator of the hoist system. In the event the operator failed to stop the traveling block from exceeding its uppermost and lowermost position, the system automatically switched off the hoist equipment if those limits were exceeded.

Although the '217 patent set out to solve the problem of unsafe hoist operation in an oil drilling rig, many drawbacks still remain when applying the '217 patent technology to a workover rig. For instance, hoist systems of workover rigs are much faster than those in oil drilling rigs, and the '217 system is not responsive enough to prevent the faster moving traveling block from crowning out or flooring out. Furthermore, the automatic switch-off system of the '217 patent provides for an abrupt stopping of the hoist system and traveling block. Abrupt stopping can cause an unsafe condition during workover operations and can possibly cause equipment damage, as the traveling block often supports a large amount of weight, often in excess of 100,000 pounds.

SUMMARY OF THE INVENTION

The present invention improves on the '217 patent technology by providing a system that is both safer and more useful on workover rigs. The technology disclosed herein provides a system that calculates traveling block position, speed, weight, and momentum before applying a braking system to slow down and eventually stop the traveling block. The system takes these parameters into consideration when slowing and/or stopping the traveling block when it reaches a crown out or floor out position. Another embodiment of the present invention involves a multiple sensor system to prevent crown incursions during rig operations. One embodiment discloses a method of placing at least two sensors at strategic positions within the derrick and using information from these sensors to first slow the blocks down and then to stop the blocks if they go within range of the upper sensor. A further embodiment utilizes a drum encoder along with the two sensors to determine the block speed and compare it to a pre-determined speed limit for that particular region that the block is traveling in. The result of the several embodiments of this invention is much safer operation of the traveling block on a workover rig, as well as on an oil drilling rig.

DESCRIPTION OF ILLUSTRATIVE EMBODIMENTS

Figure 1:
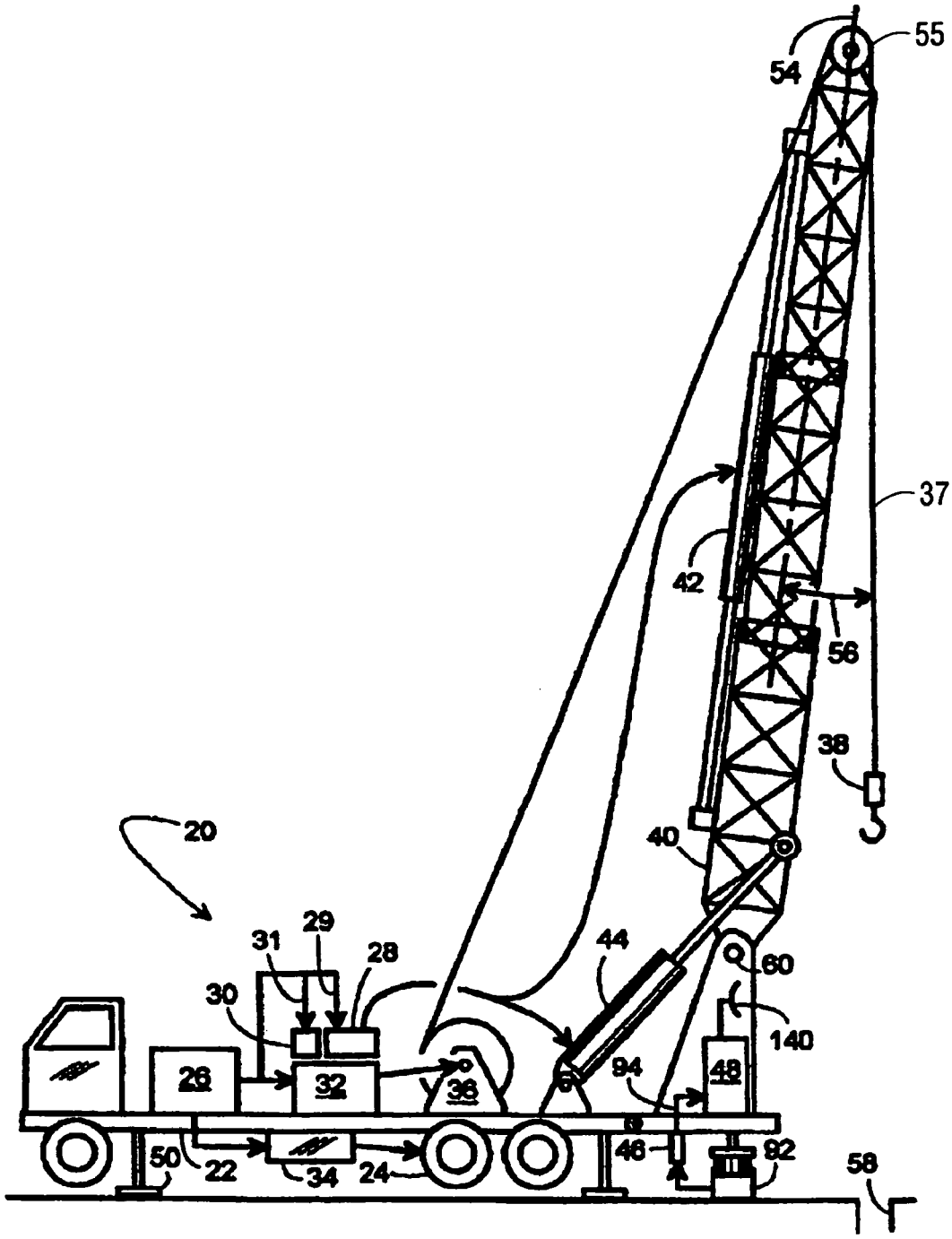
FIG. 1 is a side view of a workover rig with its derrick extended
Figure 2:
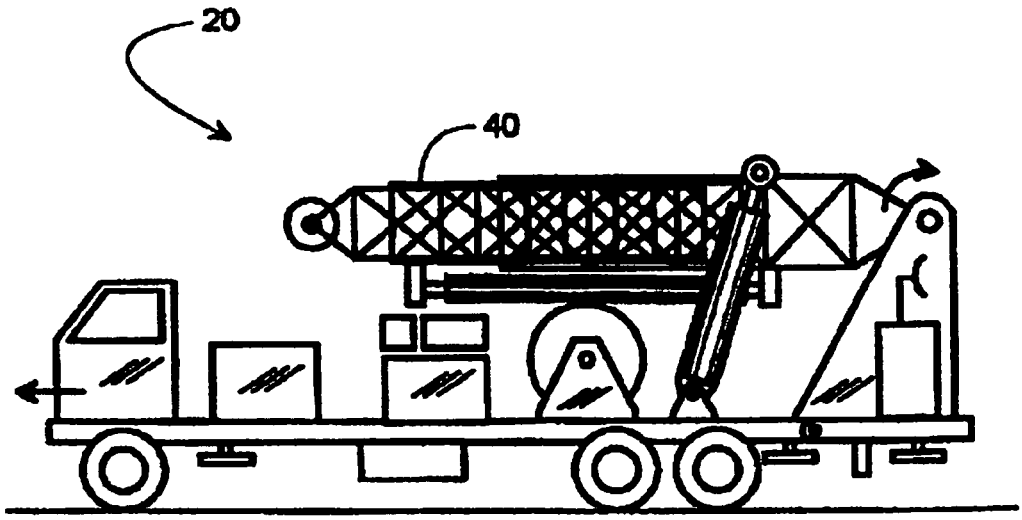
FIG. 2 is a side view of a workover rig with its derrick retracted.
Figure 3:
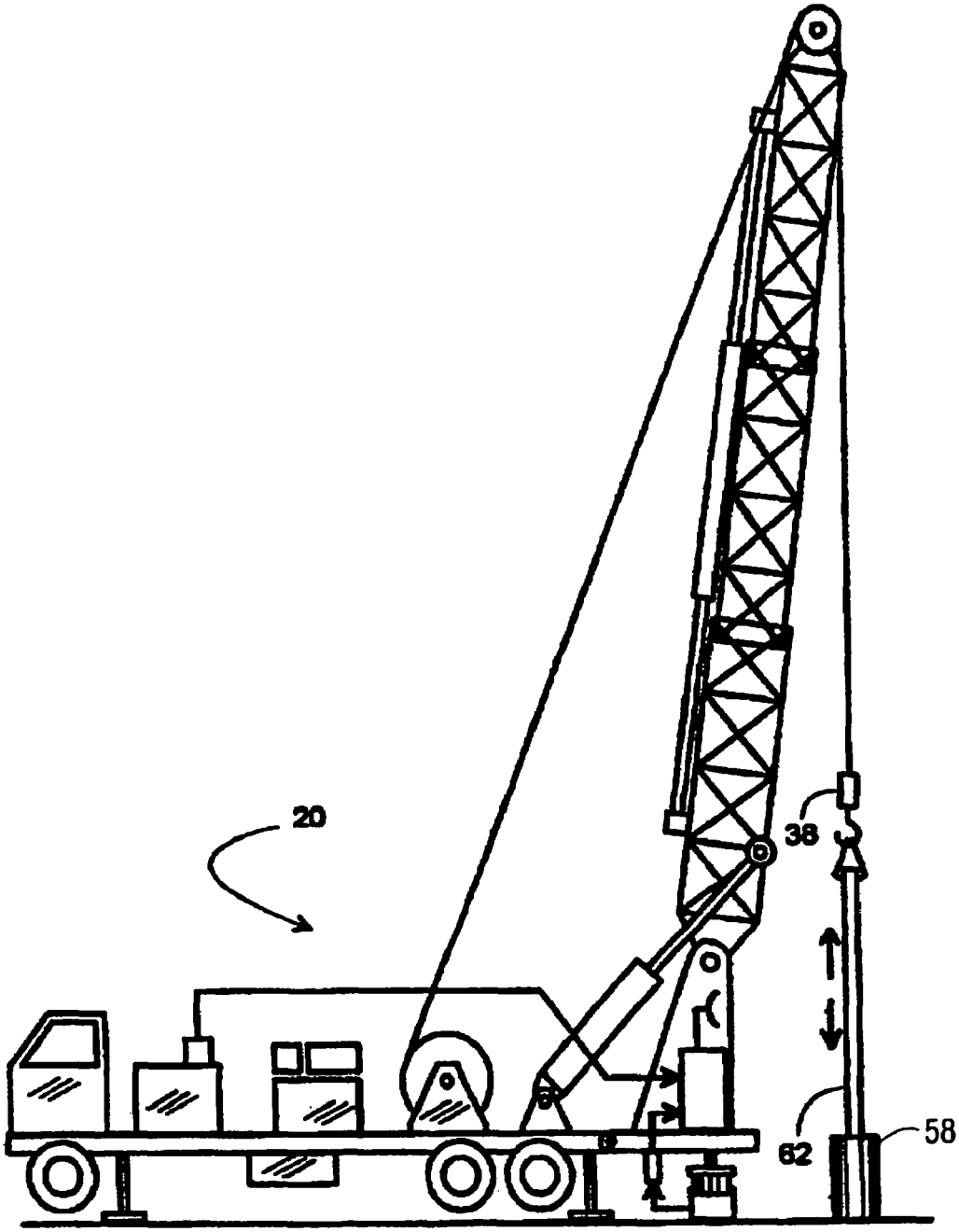
FIG. 3 illustrates the raising and lowering of an inner tubing string.

Referring to FIG. 1, a retractable, self-contained workover rig 20 is shown to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a monitor 48, and retractable feet 50. Engine 26 selectively couples to wheels 24 and hoist 36 by way of transmissions 34 and 32, respectively. Engine 26 also drives hydraulic pump 28 via line 29 and air compressor 30 via line 31. Compressor 30 powers a pneumatic slip (not shown), and pump 28 powers a set of hydraulic tongs (not shown). Pump 28 also powers cylinders 42 and 44 that respectively extend and pivot derrick 40 to selectively place derrick 40 in a working position (FIG. 1) and in a retracted position (FIG. 2). In the working position, derrick 40 is pointed upward, but its longitudinal centerline 54 is angularly offset from vertical as indicated by angle 56. This angular offset 56 provides block 38 access to a well bore 58 without interference from the derrick framework and allows for rapid installation and removal of inner pipe segments, such as inner pipe strings 62 and/or sucker rods (FIG. 3).

When installing inner pipe segments, the individual pipe segments are screwed together using hydraulic tongs (not shown). Hydraulic tongs are known in the art, and refer to any hydraulic tool that can screw together two pipes or sucker rods. During make up operations, block 38 supports each pipe segment while it is being screwed into the downhole pipe string. After that connection, block 38 supports the entire string of pipe segments so that the new pipe segment can be lowered into the well. After lowering, the entire string is secured, and the block 38 retrieves another pipe segment for connection with the entire string. Conversely, during breakout operations, block 38 raises the entire string of pipe segments out of the ground until at least one individual segment is exposed above ground. The string is secured, and then block 38 supports the pipe segment while it is uncoupled from the string. Block 38 then moves the individual pipe segment out of the way, and returns to raise the string so that further individual pipe segments can be detached from the string.

Referring back to FIG. 1, weight applied to block 38 is sensed, for example, by way of a hydraulic pad 92 that supports the weight of derrick 40. Generally, hydraulic pad 92 is a piston within a cylinder, but can alternatively constitute a diaphragm. Hydraulic pressure in pad 92 increases with increasing weight on block 38, and this pressure can accordingly be monitored to assess the weight of the block. Other types of sensors can be used to determine the weight on the block, including line indicators attached to a deadline of the hoist, a strain gage that measures any compressive forces on the derrick, or load cells placed at various positions on the derrick or on the crown. While the weight of the block can be measured in any number of ways, the exact means of measurement is not critical to the present invention, however it is important that the weight on the block is measured.

Hoist 36 controls the movement of a cable 37 which extends from hoist 36 over the top of a crown wheel assembly 55 located at the top of derrick 40, supporting travelling block 38. Hoist 36 winds and unwinds cable 37, thereby moving the travelling block 38 between its crown wheel assembly 55 and its floor position, which is generally at the wellbore 58, but can be at the height of an elevated platform located above wellbore 58 (not shown). The position of the traveling block between its crown and floor position must always be monitored, such as by the system described in the '217 patent, incorporated herein by reference.

The '217 patent system comprises a magnetic pick-up device or other electrical output type sensor is operatively situated adjacent to a rotary part of the cable hoist 36 or crown wheel assembly 55 and produces electrical impulses as the part rotates. Alternatively, a photoelectric device is used to generate the necessary electric impulses. These electrical impulses are conveyed to electronic equipment that counts the electrical impulses and associates them with a multiplier value, thereby determining the position of the traveling block. While the '217 patent describes one method of measuring the position of the traveling block, other methods are just as useful to the present invention, such as a quadrature encoder, an optical quad encoder, a linear 4-20 encoder, or other such devices known in the art. The means of sensing the position of block 38 is not important to the present invention, however it is important that the position of the block is measured and known.

Once the position of the traveling block is known, the speed of the traveling block can be easily calculated by the system described herein. For example, in is simplest form, the speed of the traveling block can be calculated by determining the traveling block position at a first point, then determining the traveling block position at a second point, calculating the distance therebetween, and dividing the distance traveled by the elapsed travel time. If a pulsed system is used, such as a quadrature encoder or an optical encoder, to determine block position, the speed can be calculated by counting the number of pulses per unit time. If a 4-20 device is used to calculate block position, the rate of change of current per unit time would need to be calculated to determine block speed, where the current is the output of the 4-20 encoder.

Once the weight, speed and position of the traveling block is known, the traveling blocks can be safely slowed and smoothly stopped by a braking system that takes into account these variables before applying the brakes to the traveling blocks. When seeking to prevent crown out, the system first senses the velocity and vertical position of the traveling blocks. Depending on which region (position) the blocks are in (FIG. 4), the processor compares the actual velocity to the maximum allowed velocity for that region. If the velocity is below the maximum allowed value, for example 2 feet per second in region 108 or maybe 4 feet per second in center region 112, then nothing happens. If on the other hand, the block velocity exceeds the desired maximum velocity for that particular region, the system can either alarm the operator he is going to fast, take away the operator's throttle authority thus slowing the blocks down, throttle the engine down to a point where the speed is reduced to an acceptable level, or any combination of or all of the above. This methodology allows the crew to operate at full horsepower pulling heavy loads at full RPM at any point along the axis of 104-106 so long as a safe operating speed limit is maintained. Each zone of travel, 108, 112, and 110, will have a maximum traveling block speed, with the middle zone 112 having a maximum speed that is greater than that of the slowing down zones 108 and 110.

Figure 4:
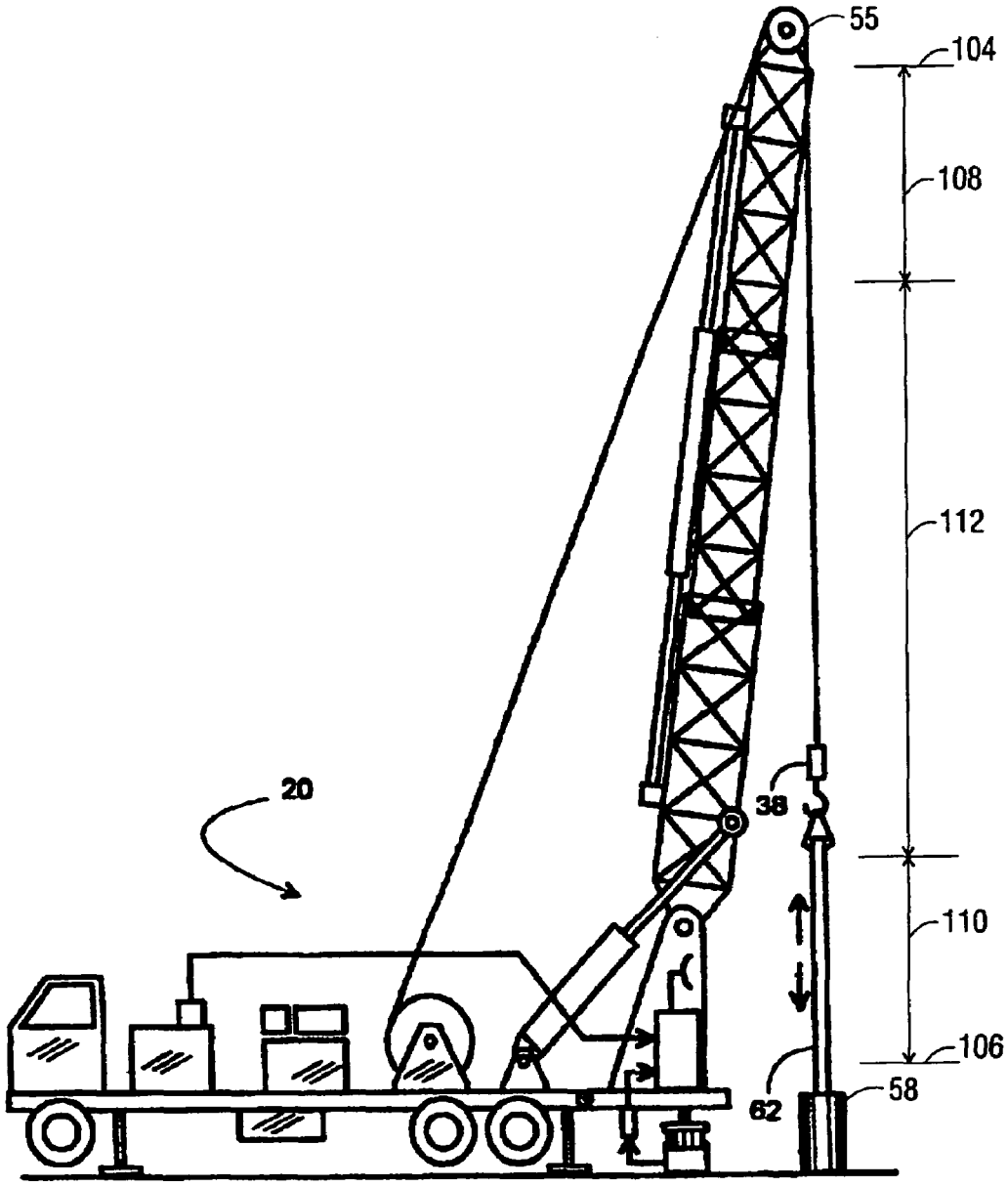
FIG. 4 illustrates one embodiment of the present invention.

On the other hand, if the ascending velocity is greater than the predetermined value, than the system automatically signals the throttle controller to slow the speed of upwards travel, regardless of the set-point provided to the throttle controller by the workover rig operator. Slowing the engine blocks down as the blocks enter into region 108 inhibits over travel as the blocks are moving slow enough to be stopped before reaching the predetermined upper limit, thereby avoiding crown out. The system can provide for an obligatory slowing down zone (region 108) in which the maximum block velocity in this region is slower than that of region 112 and is limited to a velocity which allows and accounts for intrinsic delays created by the processing time, brake action time, and on the stopping distance between the entry of the block into region 108 and the crown. In other words, there is a time factor inherent in the system for the system to sense the speed of the traveling blocks, process the data, start the braking action, and then for the drum to actually apply the brakes. In some embodiments, this time is about one half of a second, but it is within the skill of those in the art to determine what this lag time is for each individual system. The end result is that the system is allowed adequate time to slow and stop the blocks before they reach the crown out or floor out positions. Regardless of the block velocity, when the block reaches a predetermined upper limit as shown in FIG. 4 as upper point 104 (Upper Travel Limit), the system will automatically stop the traveling block's upward movement, by reducing the engine to an idle, releasing the drum clutch, and setting the drum parking brake.

A further embodiment of the present invention as it pertains to preventing crown out is a "failsafe" omni reading metal detector or ultrasonic sensor located near the crown of the rig. In one embodiment, this detector is a Banner S18M. When this detector is properly wired to the rig, which is within the skill of one familiar with such detectors, it provides an auxiliary means of stopping traveling block travel when it nears a crown out position. When placed in series with the clutch, engine throttle, and brake actuators, for example, if the detector senses metal (the traveling block), it opens the clutch, throttle, and brake circuits, thereby stopping the upward movement of said blocks. Therefore, if the processor or encoder fails during normal operation, the detector becomes a final safety device for stopping the traveling block. The detector should be set and calibrated so it will not to trip when the blocks are traveling in the normal derrick operating region, but will trip, and therefore open the circuits, when the blocks get too close to the crown, regardless of whether the encoder or processor are active or are operating normally. Thus, in the event of a processor failure, a total electrical failure, an encoder failure or other type of system failure, the detector will still prevent the traveling blocks from running into the crown.

When the block is traveling downwardly through region 108 and 112, if the velocity is below a predetermined or calculated maximum regional value, for example 8 feet per second, nothing happens. When the blocks travel into lower region 110 which is near the lower stopping point 106, the maximum allowable velocity is reduced, but again, as long as the measured velocity in that region is below the set limits, nothing happens. The maximum downward velocity in regions 104 and 108 can be input into the control system as a predetermined value, or alternatively can be calculated by a simple algebraic equation. This type of equation can take on many forms, but in one simple form this equation takes into account the weight and momentum of the traveling block. Since weight can be measured at (92), we can compute the maximum allowed velocity based on the hookload dividing the maximum allowed momentum figure by the weight, as shown below:

$$\text{Velocity max} = \text{Momentum(max)}/\text{Traveling Block Weight}$$

Figure 12:
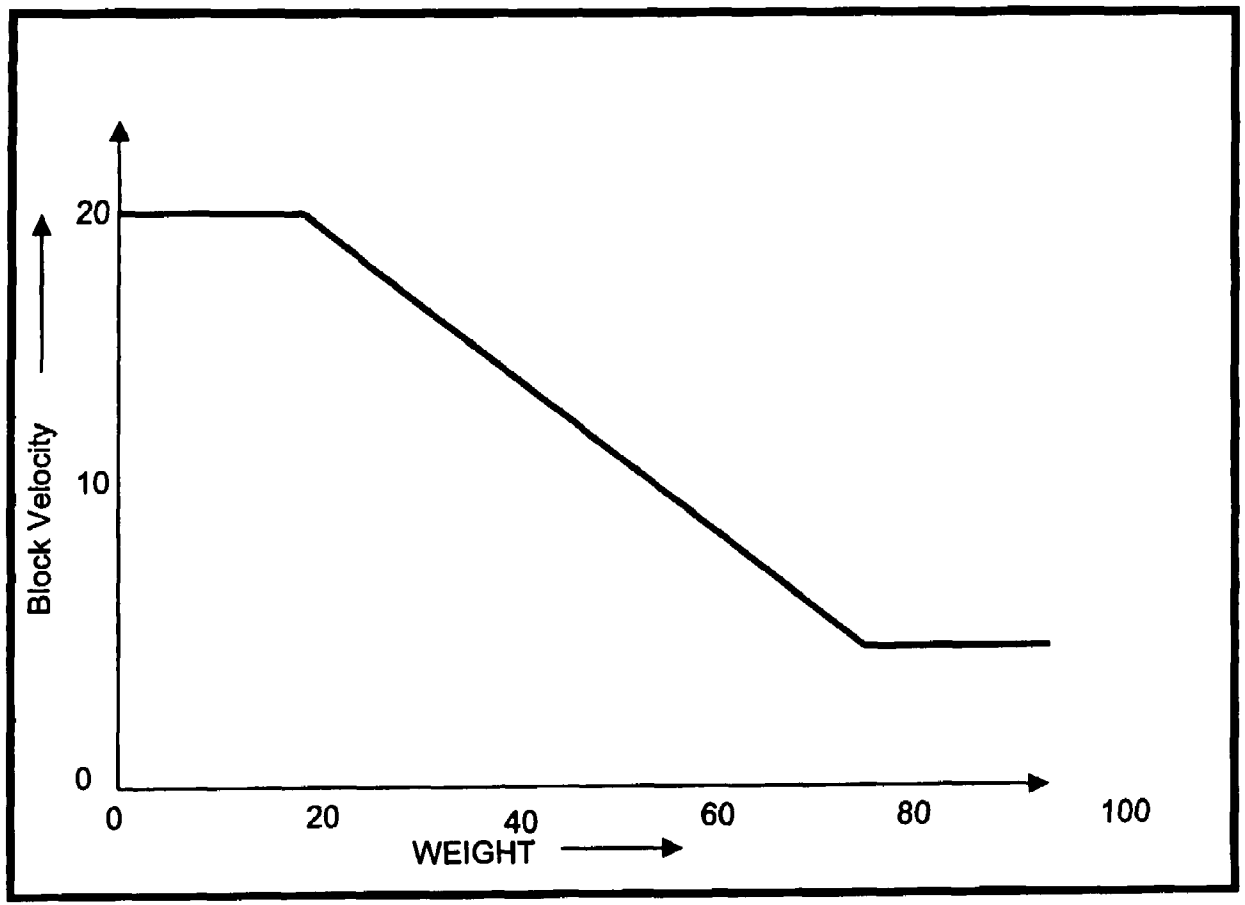
FIG. 12 illustrates one embodiment of a momentum governor chart.

In some embodiments, the weight can be measured and referenced to a predetermined block velocity vs. block weight chart as can be seen in FIG. 12. In this embodiment, once the weight is calculated, the system can refer to the chart to determine the maximum allowed block velocity of downward travel in regions 104 and 108.

Conversely, if the if the traveling block is traveling at a velocity higher than a predetermined value, the system then takes into consideration both traveling block velocity and weight before slowing down the block. For example, if the weight is 40,000 pounds, and the velocity is greater than a predetermined value, for example 2 feet per second, then at a predetermined height a signal is sent to start slowing down the downward travel of the block, so that by the time the block reaches its lowest point, it can be completely stopped before flooring out.

In one embodiment, the velocity of the traveling block is proportional to the weight on the traveling block. For instance, if at 40,000 pounds weight, the predetermined velocity limit could be 2 feet per second, whereas at 50,000 pounds the predetermined velocity limit would be lower, and at 30,000 pounds the predetermined velocity limit would be higher. This effectively calculates the momentum of the traveling block before taking into effect when how the traveling block should be slowed. In another embodiment, a single weight limit and single speed limit could be used for ease of calculation. In another embodiment, the system can allow the block to travel freely throughout the lower range if little or no weight is sensed on the traveling block.

In one embodiment, the traveling block is slowed using a pneumatic brake attached to a proportional valve. For example, if the predetermined protected range of travel is 10 feet above the lower travel limit, then at 10 feet the proportional valve can apply 10% of the air pressure to the brake. At 9 feet, the proportional valve can apply 20%, at 8 feet 30%, and so on until when the block reaches the lower travel limit a full 100% of the brake is applied and the traveling block comes to a smooth stop.

Referring now to FIG. 4, a workover rig is shown with the block supporting a string of tubing. The blocks total travel is between the crown of the hoist 55 and the floor at the well head 58. A point before crown out is the upper limit of travel 104 where the traveling block will be completely stopped by the system. A point before floor out is the lower limit of travel 106 where the traveling block will also be completely stopped by the system. A range below the upper limit is the upper protected travel range 108. As described above, in this range if the velocity exceeds a predetermined value, a signal is sent to the engine governor to slow down the velocity of the traveling block so that when it reaches its upper limit of travel 104 it can be safely stopped. Similarly, a range above the lower limit is the lower protected travel range 110. As described above, in this range the velocity and weight (if desired) is measured, and if the velocity or momentum of the traveling block exceeds a predetermined value, a signal is sent to the brake to begin slowing down the traveling block so that when it reaches its lower limit 106 it can be safely stopped.

In some embodiments, the operator is provided with an override button so that, if necessary, operator control can be maintained over the block throughout the entire range of travel without the automatic control system taking over.

Figure 5:
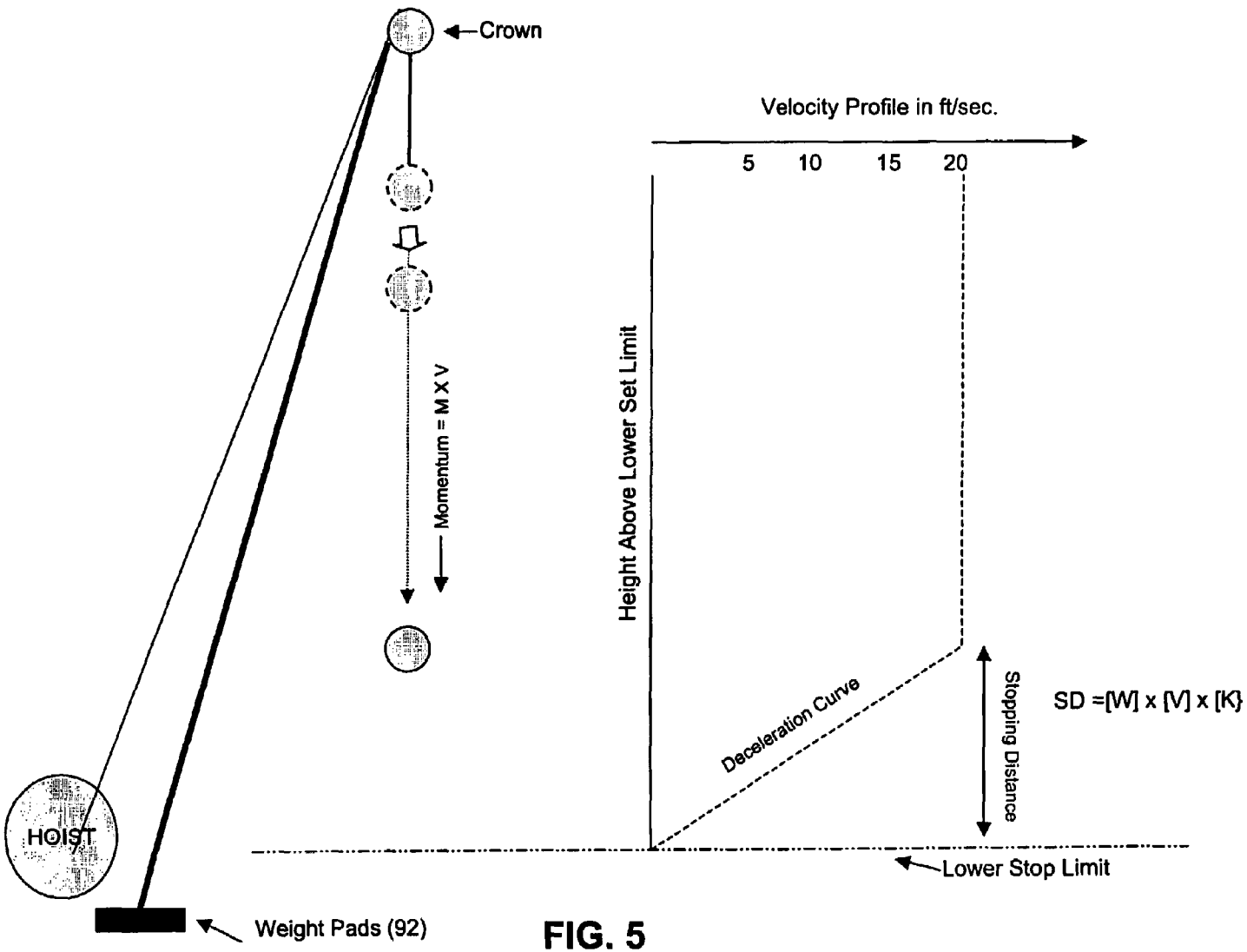
FIG. 5 shows a schematic of traveling block control for preventing floor out.

Referring now to FIGS. 5-9, a further embodiment of the present invention is shown in graphical form. When the block is traveling down, as shown in FIG. 5, the momentum of the block could be calculated by multiplying the weight on the block by the speed, or velocity, of the block. The distance needed to bring the load to a full stop will increase as the momentum increases. Therefore, a stopping distance "SD" is calculated by multiplying the momentum of the block times a "K" value, which is simply an input in the control system that is breaking the block. The rig mounted control system calculates the stopping distance based on this equation. The stopping distance is defined herein as the distance above the lower stop limit of the block. The lower stop limit is the lowest point at which the block is allowed to travel, and will usually be set in the control system by the rig operator.

Referring first to FIG. 5, the block is shown to be moving down at a speed of 20 feet per second. If the hookload is, for example, 100,000 pounds and a K value of 0.00001 s/lb is used by the computer, the stopping distance SD would be calculated to be 20 feet above the lower stop limit. When the block reaches the calculated stopping distance point, the control system would then send a variable electric signal via a PID loop to the breaking device on the rig. In one embodiment, the electric signal would be sent an electro-pneumatic transducer or proportional valve whose function is to take the electrical signal and output an air pressure proportional to the electrical signal. The output air from is then piped to an actuating air cylinder on the brake, thereby starting the braking action on the block. In one embodiment, a PID controller (proportional integral derivative) is used to slow the block between the stopping distance point to the lower stop limit. A PID controller would simply monitor the velocity or the momentum of the block and send a signal to the aforementioned electro-pneumatic transducer or proportional valve to add or reduce air pressure as needed to stay on the desired deceleration curve, as shown in FIG. 5.

Figure 6:
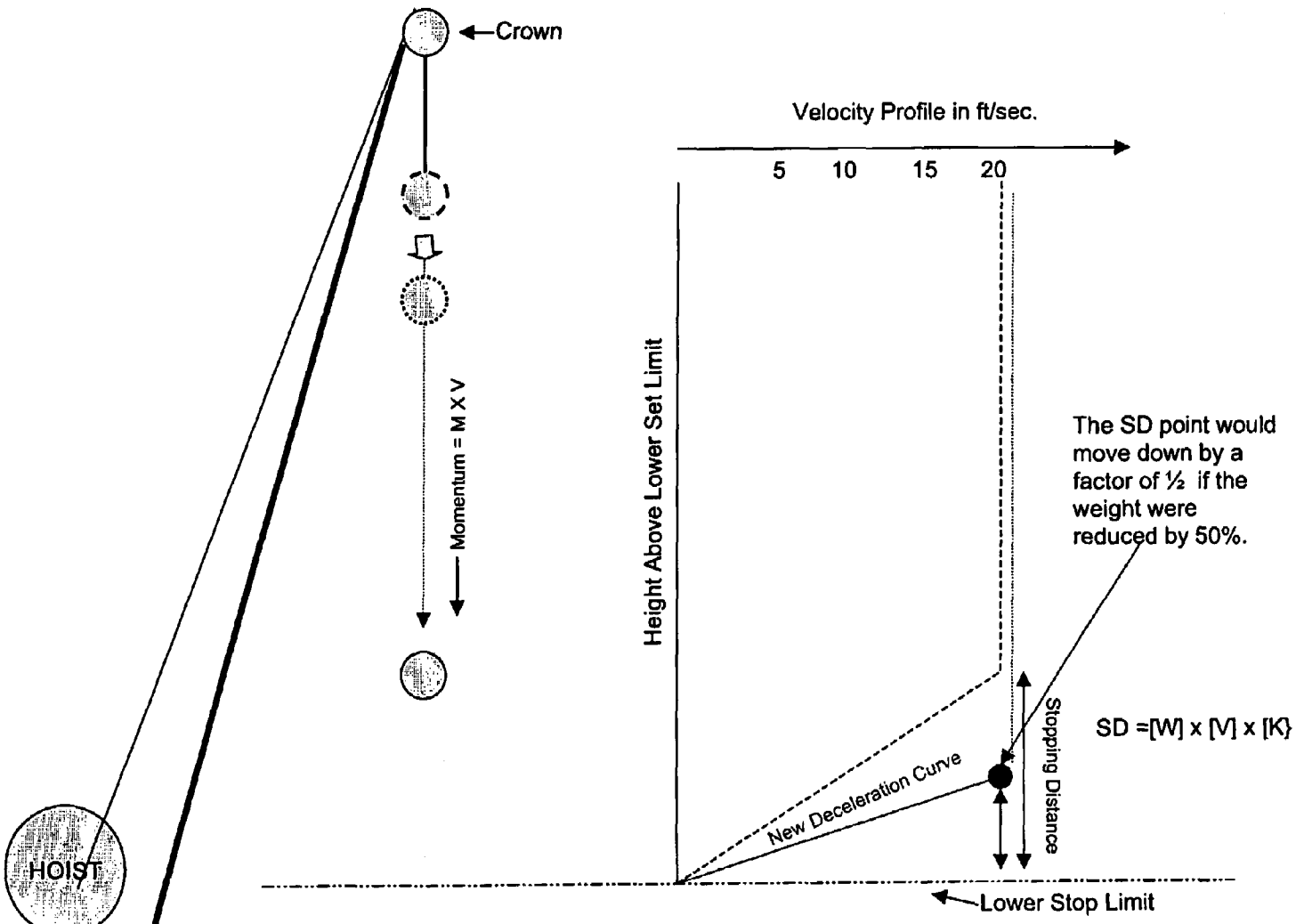
FIG. 6 shows an alternate embodiment of traveling block control for preventing floor out.
Figure 7:
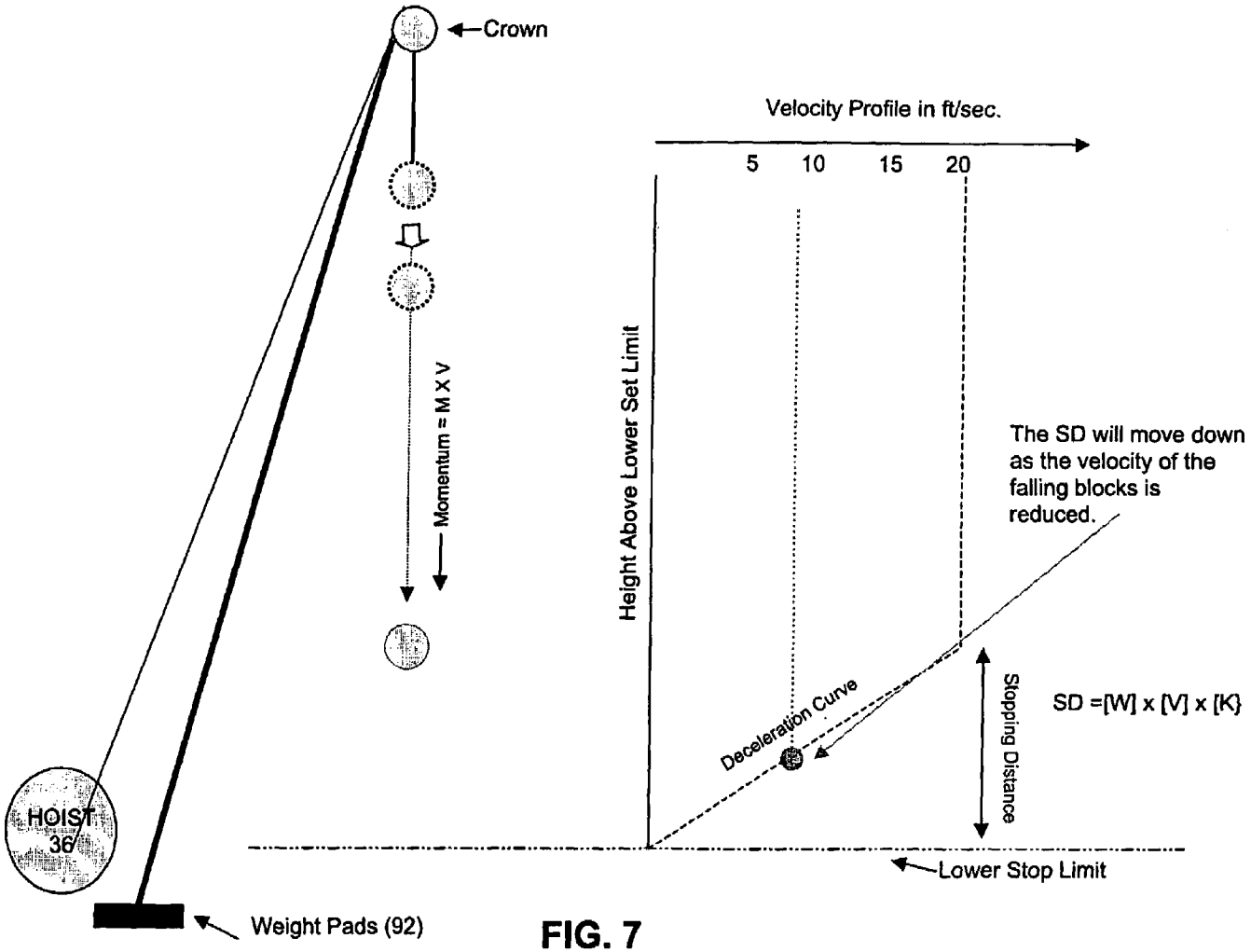
FIG. 7 shows a further alternate embodiment of traveling block control for preventing floor out.

Referring now to FIG. 6, it can be seen that as the weight decreases, the stopping distance point would be closer to the lower stop limit. Comparing FIG. 6 to FIG. 5, if 50,000 pounds was lowered into the hole using the same K-value, both the stopping distance and the slope of the deceleration curve would be half that of lowering 100,000 pounds into the hole. Referring now to FIG. 7, it can be seen that as the velocity decreases while maintaining the same weight on the block, the stopping distance decreases, however the slope of the deceleration curve remains the same. Comparing FIG. 7 to FIG. 5, if 100,000 pounds is being lowered at 10 ft/sec instead of 20 ft/sec at the same K value, the stopping distance would be half that of lowering 100,000 pounds at 20 ft/s, but the slope of the deceleration curve remains the same.

Figure 8:
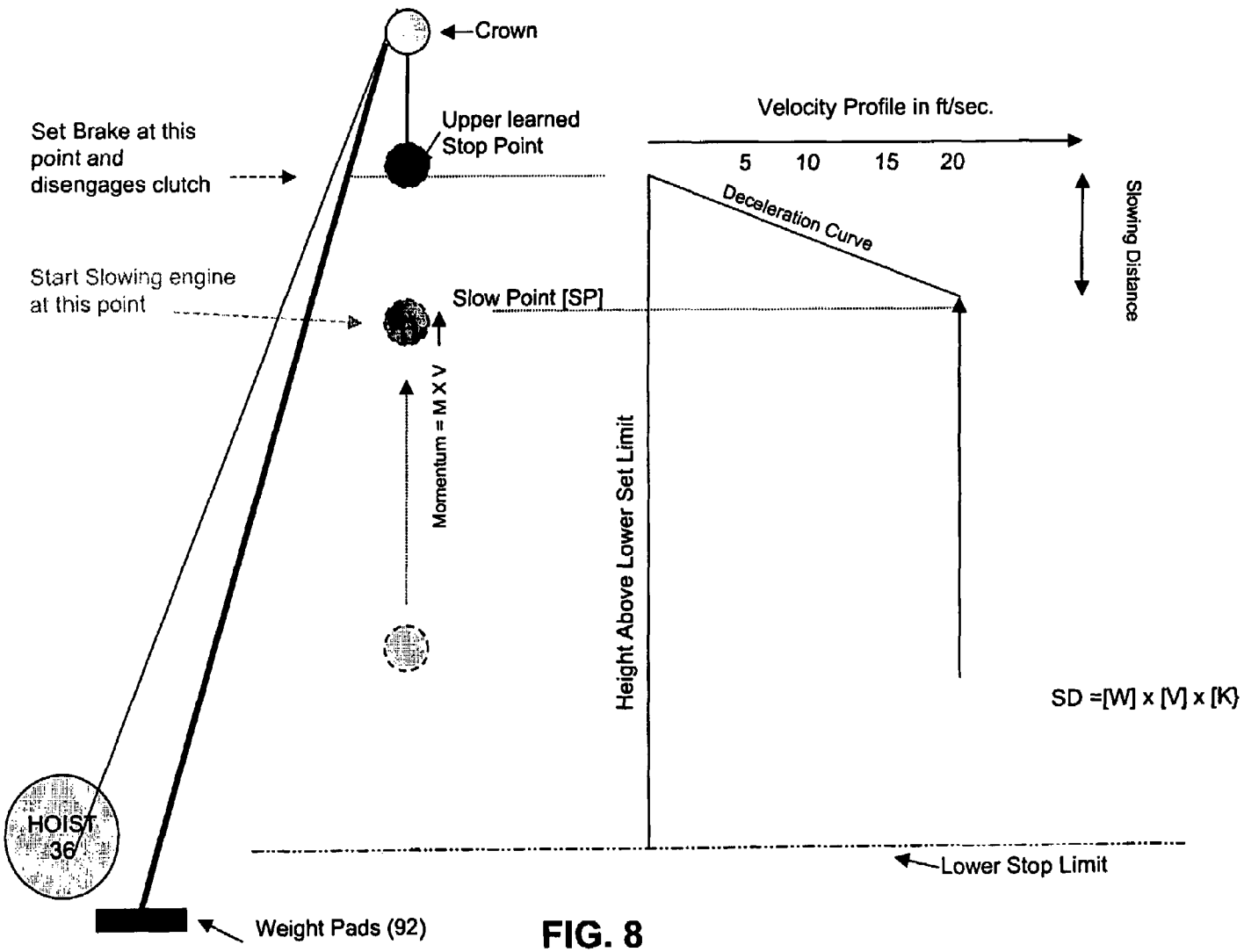
FIG. 8 shows a schematic of traveling block control for preventing crown out.
Figure 9:
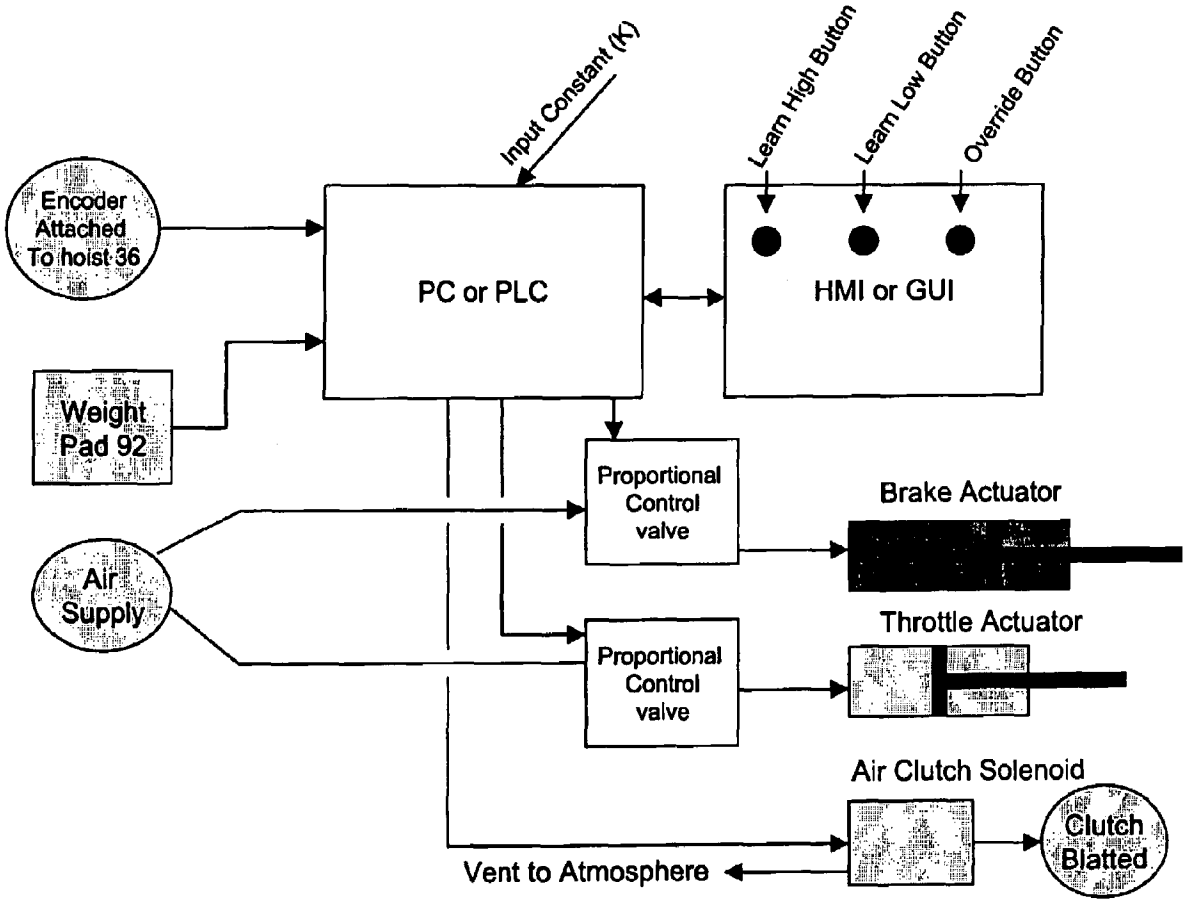
FIG. 9 illustrates a simple block diagram of one embodiment of the control system of the present invention.

In the hoisting mode, the same general concept is illustrated in FIG. 8. The upward velocity is monitored by the control system, and at some predetermined slow point, which is a point somewhere below the upper most point of travel of the block, the control system initially starts slowing the engine down, thereby slowing to block down. Thus, instead of actuating a brake as in the case of downward block travel, the speed of the hoist is simply slowed so as to slow the block. This can be accomplished by having the control system signal a proportional controller on the engine throttle which, like with the brake, responds proportionally to the control signal to slow the block. The slow point for upward travel is calculated based on block speed, weight, and a K factor, much like the way the stopping distance for downward travel is calculated. In some embodiments, weight may be discarded and only velocity considered to determine the slow point. At the slow point, the control system takes over with a PID controller, keeping the block on the deceleration curve by slowing the engine down. The brake can still be used in upward travel, particularly if the block reaches the upper stop point, or the highest travel position of the block which is set by the operator. Once this position is reached, the control system can set the brake and release the drum clutch, causing the drum to stop rotating and thereby ceasing upward block travel. A simple block diagram outlining the entire system is shown in FIG. 9.

A further embodiment of the present invention involves a momentum governor for the rig. This momentum governor is not only useful to protect crown out and floor out of the traveling block, but also is useful for protecting the rig and crew members from over-stressing the tubulars and the derrick while the rig is running tubulars into the hole. In standard operation, when running into the whole, it is desirable that the traveling block be allowed to fall freely through regions 108 and 112 if lightly loaded, slowing it down or regulating its speed if it is heavily loaded. FIG. 12 illustrates one example of this concept. For instance, if the weight on the traveling blocks is less than 20,000 pounds, they are allowed to travel at speeds up to 20 feet per second. As the hook load gets heavier, the maximum allowed velocity is lowered so as to maintain the momentum of the traveling block within a save envelope. For instance, according to this chart, at 40,000 pounds on the block the maximum downward velocity may be 11 feet per second. Finally, at hook loads above 75,000 pounds, the maximum downward velocity would be around 4 feet per second. This momentum governor would only apply to regions 108 and 112 of FIG. 4, and would have no application in the aforementioned floor out control portion of the crown out/floor out apparatus. Of course, the weights and speeds listed herein are used for example purposes only. The actual values used will differ from rig to rig and will need to be determined by the rig operator before using this momentum governor. The actual values will depend on a number of factors, including type of rig, operating parameters of the rig operator, and the safety level the operator wishes to operate under.

Figure 10:
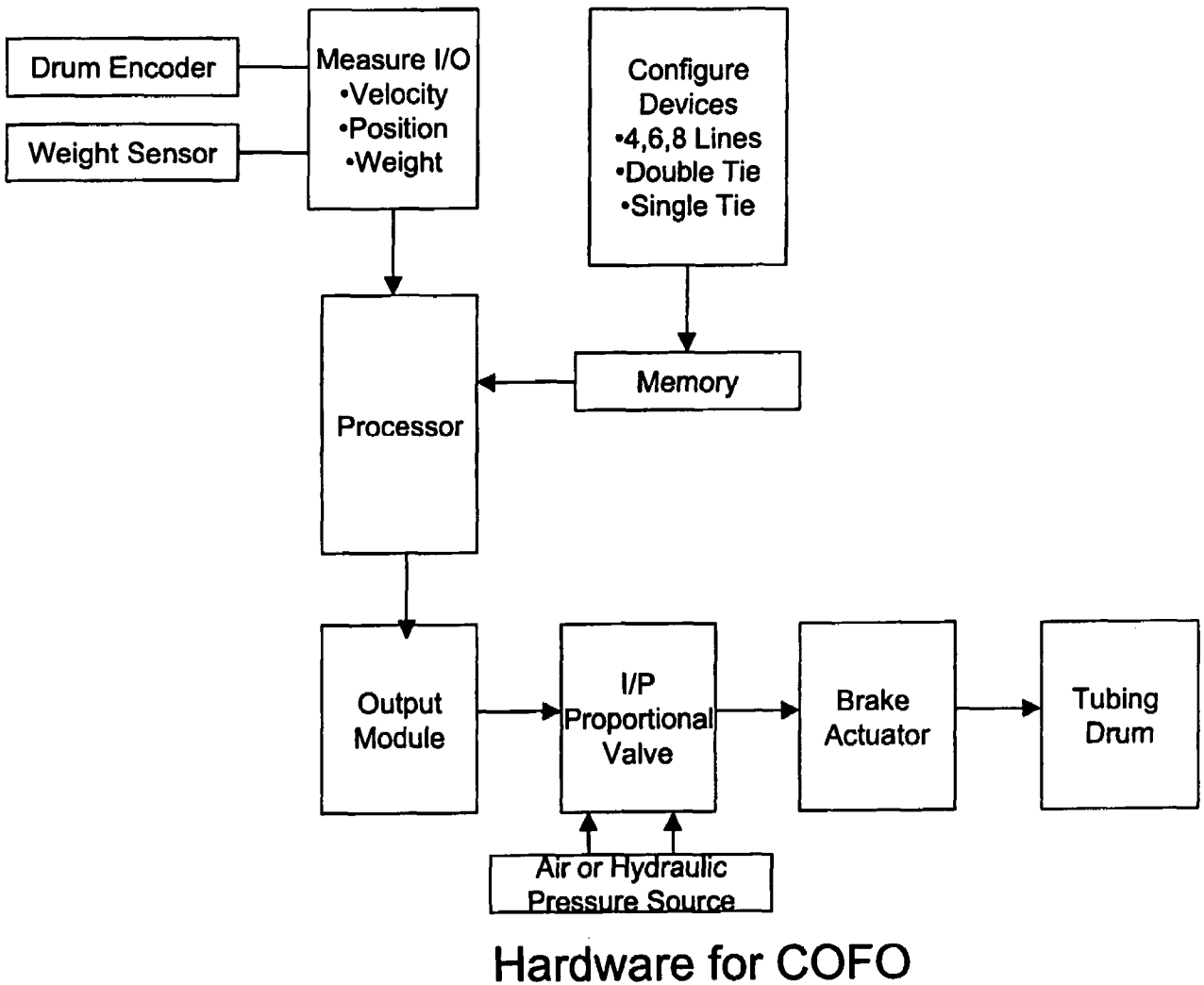
FIG. 10 shows a simple schematic diagram of the crown out/floor out/momentum governor system of the present invention.

Referring now to FIG. 10, a simple schematic diagram of the crown out/floor out/momentum governor system. Inputs from the tubing drum encoder (or any other block position indicator) and the weight sensor are inputted into the system, and the velocity, position, and weight on the traveling block are then calculated based on the sensor inputs. The system processor, using a PID loop, compares the actual velocity and weight to what is in the system memory. In one embodiment, the system memory is predetermined in separately inputted, however as described above, in a separate embodiment the system memory can be in the form of a chart as shown in FIG. 12. The PID loop, in comparing the actual data to the data in memory, ensures that the system is either on or below the line on the chart or below the predetermined velocity values for its given position.

Figure 11:
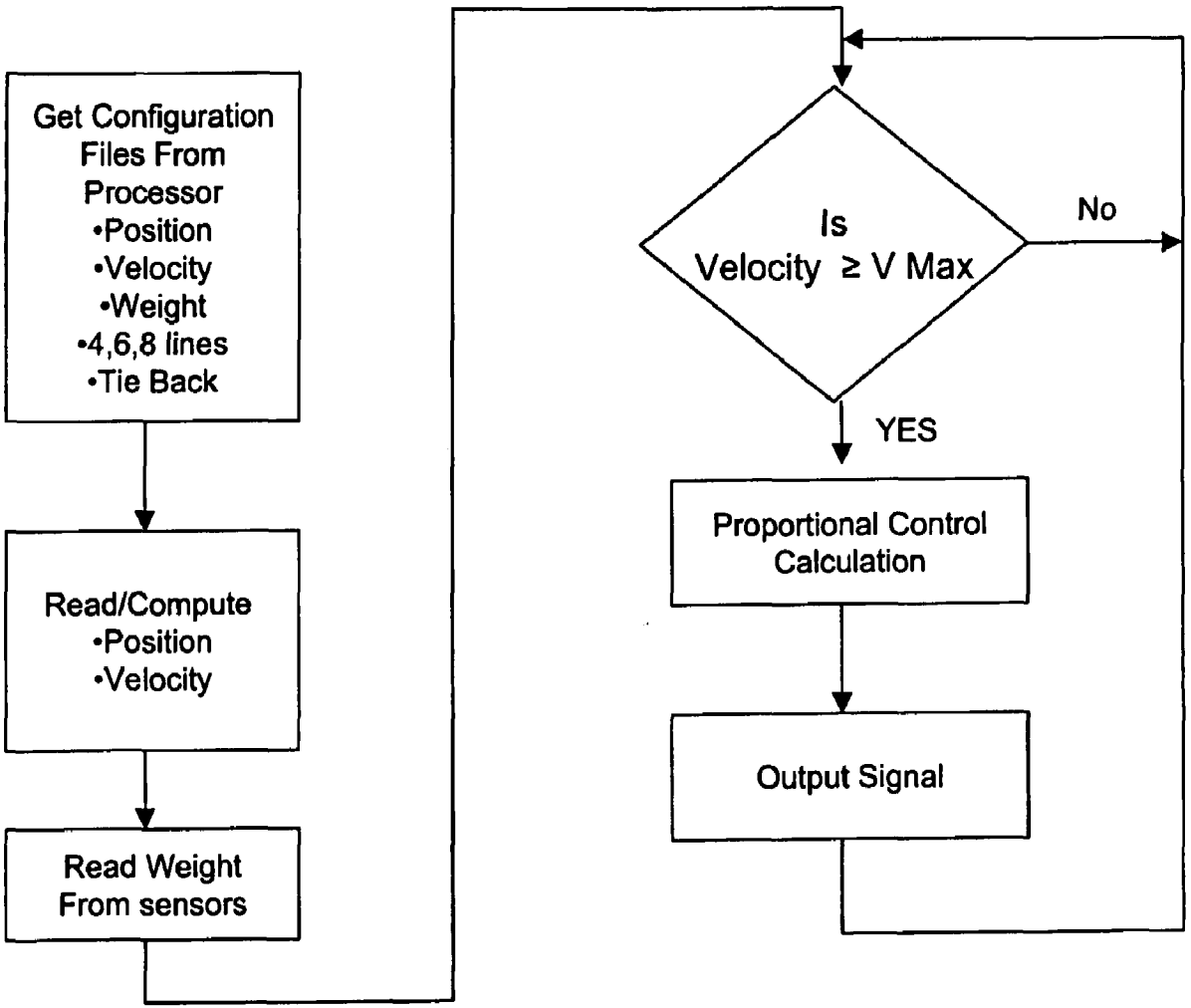
FIG. 11 sets forth a logic diagram showing how one embodiment of this system operates.

Referring to FIG. 11, a logic diagram showing how this system works is set forth. If the velocity is greater than the maximum allowed, the PID controller sends an output signal to the output module which in turn will actuate the brake to slow the traveling block. This process is repeated until the block stops or reaches the floor out position, or in the case of an ascending traveling block, the loop will retard the throttle to slow the block down. Of course, the maximum velocity will change as the traveling block enters either of the top or bottom slowdown zones.

In one example of this system in application, assume that the operator is running a heavy string of tubing into the hole and exceeds the maximum allowed velocity. If the bottom of the tubing were to stack out on a scale ledge, if only for a moment, if the blocks are descending too rapidly, it will overrun the tubing after the tubing has stopped its downward movement. If the tubing breaks loose, it can fall and cause a sudden impact on the traveling block. This is actually a common occurrence in the field. The force of the free falling tubing, sometimes in excess of 100,000 pounds, can cause significant damage to the rig and tubing, causing an unsafe situation for the operator. Using this system, if the maximum velocity is exceeded, the traveling block is automatically slowed, thereby significantly reducing the chances of this type of catastrophic event by allowing the operator to catch the blocks before they are allowed to overrun the tubing.

In another embodiment of this invention, all near crown or near floor incidents are captured in a data logger. For example, whenever the rig control system takes control of the blocks and stops them because they are too near the stop points, it is captured as an event and stored on a computer resident with the service rig. This event can then be transmitted to a central computer system, making it available to the management of the well service company. Since it is recorded, the well service company will be able to tell if the operator ran the rig dangerously or running it too close to the limits of the rig.

Another embodiment of the present invention comprises a multiple sensor system to prevent crown incursion on an oil rig. As described above, an upper sensor acts as a fail safe device and stop the blocks prior to hitting the crown. If however, there is a glitch in the encoder system and the blocks are not slowed down sufficiently, the traveling block velocity can be so great that once the sensor detects the presence of the blocks and activate a shut down sequence, the velocity related over-travel is so great that the traveling block may very well hit the crown anyway. This is more likely to happen if the encoder or microprocessor fails and the slowdown region is no longer defined.

An additional traveling block sensor located somewhere below the crown where the mandated slow down is to occur solves the problem. Therefore, if the encoder system fails, this additional sensor can retard the throttle and therefore slow the upward moving blocks to a safe speed where when and if detected by the upper failsafe sensor, the shut down sequence can have the time to sense and stop the blocks before hitting the crown.

Figure 13:
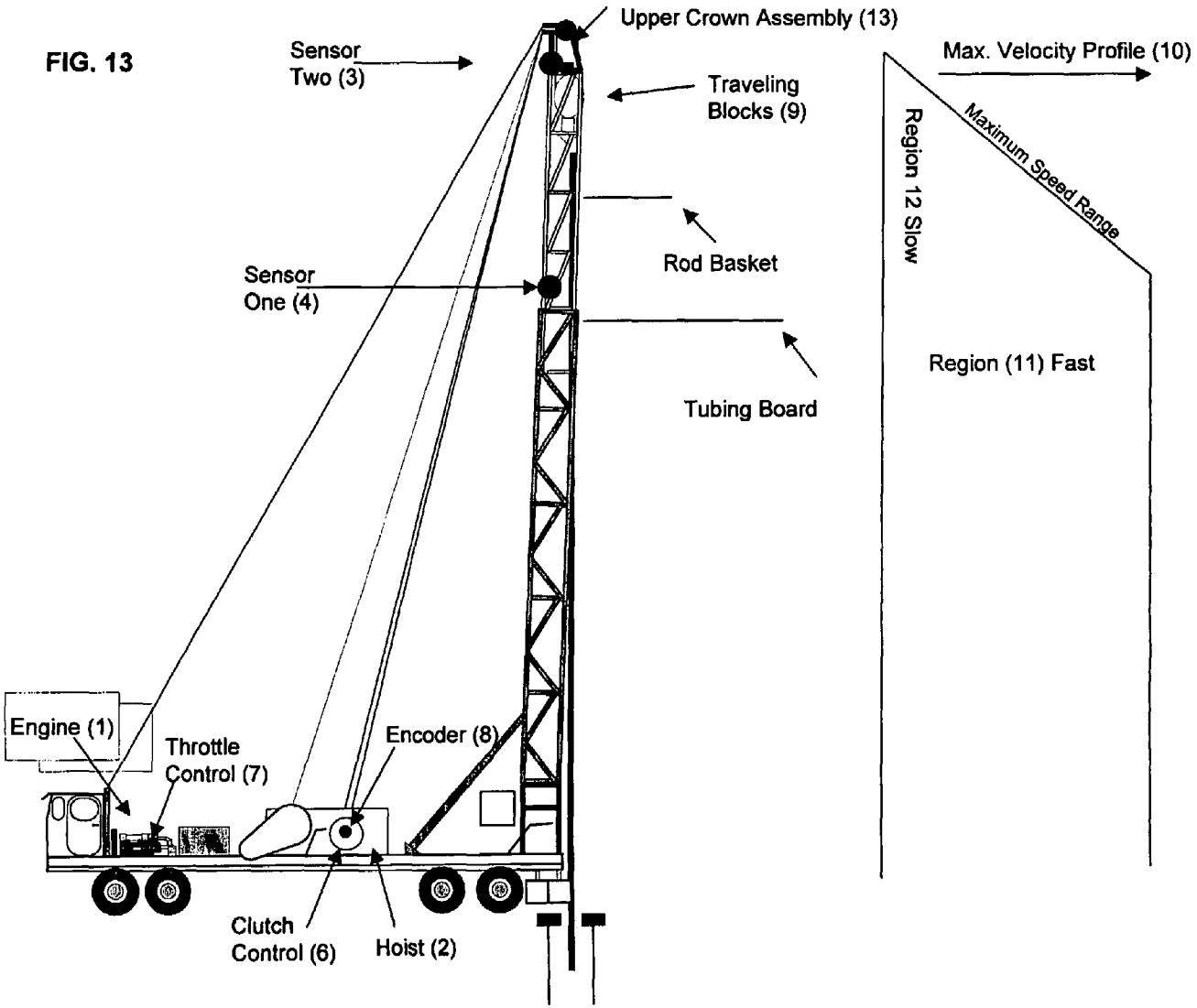
FIG. 13 illustrates one embodiment of the present invention.

Referring to FIG. 13, a second sensor (4) is added to the system for additional safety. Sensor (4) is used to physically define the length [distance between the crown (13) and the location of sensor (4)] as well as the location of slow down region (12) independently of the encoder calculations. Therefore, when traveling block (9) is detected by sensor (4), the microprocessor knows that the region (12) limits apply. If the operator of the rig is within the speed limits as defined for region (12), nothing happens as the system recognizes that the traveling block is traveling at a safe speed. If the operator of the rig is outside the speed limits as defined for region (12), microprocessor via can activate the brakes and stop the traveling block, or reduce throttle to slow the traveling block. Second sensor (4) can be any type of sensor that can detect the traveling block, such as a metal detector or an ultrasonic sensor.

Figure 14:
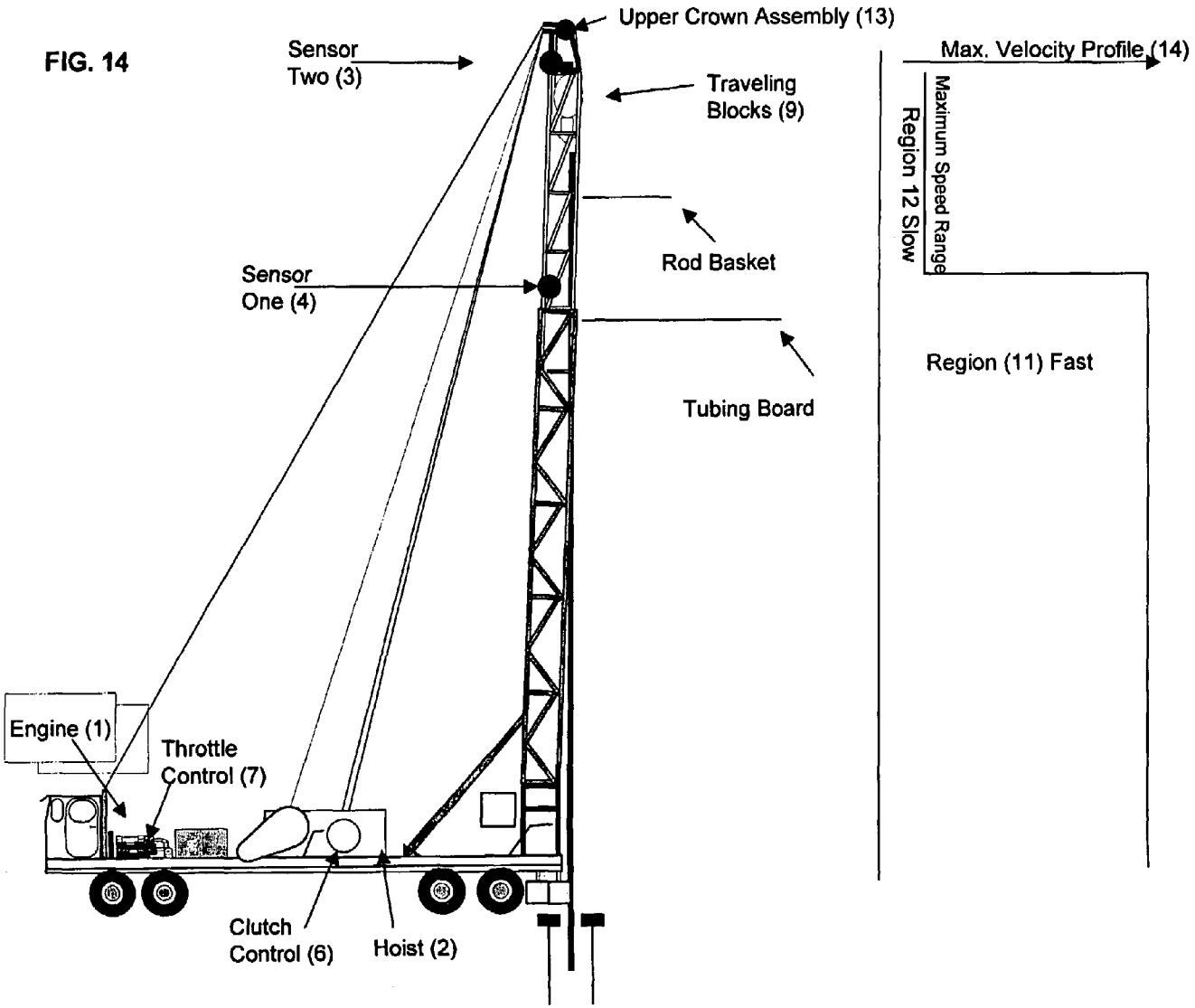
FIG. 14 illustrates an alternative embodiment of the present invention.

Referring now to FIG. 14, a further embodiment of the multiple sensor system is shown. The encoder system can be eliminated altogether for crown out protection by placing the sensor at the mandatory slow down point. When traveling blocks (9) are detected by sensor (4), microprocessor (20) commands throttle control (7) to go to an idle or to a preset lower speed to slow the blocks down, eventually stopping the blocks altogether when detected by the upper sensor (3). The resultant velocity profile is shown as (14). This embodiment is limited in scope as it mandates a sudden reduction in upward speed of the blocks which slows down overall rig operation, but it is a viable alternative for the multiple sensor system when physical limits prohibit the installation of a drum mounted encoder. In an alternative embodiment, microprocessor (20) can be eliminated altogether by simply wiring an electronic throttle control in series with sensor (4). Therefore when sensor (4) detects blocks (9), the electrical circuit is broken, thereby forcing the engine to an idle.

While the apparatuses and methods of the present invention have been described in terms of preferred embodiments, it will be apparent to those of skill in the art that variations may be applied to what has been described herein without departing from the concept and scope of the invention. All such similar substitutes and modifications apparent to those skilled in the art are deemed to be within the scope and concept of the invention as it is set out in the following claims. For instance, many of the embodiments were described as being useful on well service rigs, however each embodiment is equally useful on standard drilling rigs and other types of oil rigs.

What is claimed is:

1. A process for preventing crown incursion of a traveling block on an oil rig, comprising:

determining the speed of the traveling block;

defining an upper slow down region of travel for the traveling block wherein the length of the upper slow down region is proportional to a momentum of the traveling block;

sensing the traveling block at the bottom of the upper slow down region;

comparing the speed of the traveling block to a maximum velocity value for the upper slow down region; and adjusting the speed of the traveling block so as to maintain its speed at or below the maximum velocity value.

2. The process of claim 1, further comprising placing a traveling block sensor at the bottom of the upper slow down region and using the traveling block sensor to sense the traveling block at the bottom of the upper slow down region.

3. The process of claim 2, wherein the traveling block sensor signals the entry of the traveling block in the upper slow down region independent of an encoder calculation.

4. The process of claim 1, wherein the traveling block sensor is selected from the group consisting of a metal detector and an ultrasonic sensor.

5. The process of claim 1, wherein the speed of the traveling block is adjusted by slowing down the speed of an engine controlling the traveling block.

6. The process of claim 1, wherein an alarm is sounded when the speed of the traveling block exceeds the maximum velocity value.

7. The process of claim 1, wherein the maximum velocity value in the upper slow down region is lower than the maximum velocity value at a point immediately below the upper slow down region.

8. The process of claim 7, wherein the maximum velocity value in the upper slow down region continually decreases from the bottom of the region to the top of the region.

9. The process of claim 1, further comprising the steps of:

sensing when the traveling block has reached an upper most position; and stopping the movement of the traveling block when the upper most position is reached.

10. The process of claim 9, wherein the sensing of the upper most position is accomplished with a metal detector sensing the traveling block.

11. The process of claim 1, wherein the traveling block speed is slowed using a pneumatic brake attached to a proportional valve.

12. A process for preventing crown incursion of a traveling block on an oil rig, comprising:

defining an upper slow down region of travel for the traveling block;

sensing the traveling block at the bottom of the upper slow down region wherein the length of the upper slow down region is proportional to a momentum of the traveling block;

slowing the speed of the traveling block once the traveling block is sensed at the bottom of the upper slow down region.

13. The process of claim 12, further comprising placing a traveling block sensor at the bottom of the upper slow down region and using the traveling block sensor to sense the traveling block at the bottom of the upper slow down region.

14. The process of claim 13, wherein the traveling block sensor signals the entry of the traveling block in the upper slow down region independent of an encoder calculation.

15. The process of claim 12, wherein the traveling block sensor is selected from the group consisting of a metal detector and an ultrasonic sensor.

16. The process of claim 12, wherein the speed of the traveling block is adjusted by slowing down the speed of an engine controlling the traveling block.

17. The process of claim 12, wherein an alarm is sounded when the traveling block is sensed at the bottom of the upper slow down region.

18. The process of claim 12, further comprising the steps of:

sensing when the traveling block has reached an upper most position; and stopping the movement of the traveling block when the upper most position is reached.

19. The process of claim 18, wherein the sensing of the upper most position is accomplished with a traveling block sensor selected from the group consisting of a metal detector and an ultrasonic sensor.

20. The process of claim 12, wherein the traveling block speed is slowed using a pneumatic brake attached to a proportional valve.

21. The process of claim 12, wherein the traveling block is slowed by idling an engine.

22. The process of claim 12, wherein the traveling block is slowed by setting the speed of the traveling block to a predetermined slower speed.

23. An apparatus for preventing crown incursion of a traveling block on an oil rig, comprising:

a first traveling block sensor located at the top of an upper slow down region of travel for the traveling block; and a second traveling block sensor located at the bottom of the upper slow down region of travel for the traveling block;

wherein the length of the upper slow down region is proportional to a momentum of the traveling block.

24. The apparatus of claim 23, wherein the first and second traveling block sensors are selected from the group consisting of a metal detector and an ultrasonic sensor.

25. The apparatus of claim 23, further comprising an alarm that is activated when the traveling block is sensed by the second traveling block sensor.

26. The apparatus of claim 23, further comprising an alarm that is activated when the traveling block is sensed by the first traveling block sensor.

27. The apparatus of claim 23, further comprising a brake for slowing the traveling block when it is sensed by the second traveling block sensor.

28. The apparatus of claim 26, wherein the traveling block is slowed using a pneumatic brake attached to a proportional valve.

29. The apparatus of claim 23, further comprising a brake for stopping the traveling block when it is sensed by the first traveling block sensor.

30. The apparatus of claim 23, further comprising a microprocessor for calculating the speed of the traveling block, wherein the microprocessor slows the speed of the traveling block when the traveling block is sensed by the second traveling block sensor.

31. The apparatus of claim 23, wherein the second traveling block sensor signals the entry of the traveling block in the upper slow down region independent of an encoder calculation.

* * * * *